US009599916B2

(12) United States Patent
Asano et al.

(10) Patent No.: US 9,599,916 B2
(45) Date of Patent: Mar. 21, 2017

(54) ELECTROPHOTOGRAPHIC PHOTORECEPTOR, IMAGE FORMING APPARATUS, AND PROCESS CARTRIDGE

(71) Applicants: Tomoharu Asano, Kanagawa (JP); Eiji Kurimoto, Shizuoka (JP); Tetsuro Suzuki, Shizuoka (JP); Daisuke Nii, Shizuoka (JP); Toshihiro Ishida, Shizuoka (JP)

(72) Inventors: Tomoharu Asano, Kanagawa (JP); Eiji Kurimoto, Shizuoka (JP); Tetsuro Suzuki, Shizuoka (JP); Daisuke Nii, Shizuoka (JP); Toshihiro Ishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/933,413

(22) Filed: Nov. 5, 2015

(65) Prior Publication Data

US 2016/0161871 A1 Jun. 9, 2016

(30) Foreign Application Priority Data

Dec. 5, 2014 (JP) ..... 2014-246656

(51) Int. Cl.
*G03G 5/14* (2006.01)
*G03G 5/043* (2006.01)

(52) U.S. Cl.
CPC ..... *G03G 5/144* (2013.01); *G03G 5/043* (2013.01); *G03G 5/142* (2013.01)

(58) Field of Classification Search
CPC ..... G03G 5/043; G03G 5/144; G03G 5/142
See application file for complete search history.

(56) References Cited

U.S. PATENT DOCUMENTS

| | | | | |
|---|---|---|---|---|
| 7,521,161 | B2 * | 4/2009 | Kinoshita | G03G 5/142 399/111 |
| 8,956,794 | B2 * | 2/2015 | Yamamoto | G03G 5/144 430/61 |
| 2008/0008950 | A1 * | 1/2008 | Wu | G03G 5/0514 430/58.8 |
| 2010/0129744 | A1 * | 5/2010 | Wu | G03G 5/0539 430/58.8 |
| 2013/0017478 | A1 * | 1/2013 | Oda | G03G 15/75 430/56 |

FOREIGN PATENT DOCUMENTS

| | | | |
|---|---|---|---|
| JP | 2006-030700 | | 2/2006 |
| JP | 2008-096527 | | 4/2008 |
| JP | 2008-299020 | | 12/2008 |
| JP | 2009198707 | A * | 9/2009 |
| JP | 2010224173 | A * | 10/2010 |
| JP | 2012-058597 | | 3/2012 |

* cited by examiner

*Primary Examiner* — Francis Gray
(74) *Attorney, Agent, or Firm* — Oblon, McClelland, Maier & Neustadt, L.L.P.

(57) ABSTRACT

An electrophotographic photoreceptor includes a substrate, an undercoat layer overlying the substrate, and a photosensitive layer overlying the undercoat layer. The undercoat layer includes a binder resin, a metal oxide particle and a compound having a thiol group.

7 Claims, 3 Drawing Sheets

ELECTROPHOTOGRAPHIC PHOTORECEPTOR, IMAGE FORMING APPARATUS, AND PROCESS CARTRIDGE

CROSS-REFERENCE TO RELATED APPLICATIONS

This patent application is based on and claims priority pursuant to 35 U.S.C. §119 to Japanese Patent Application No. 2014-246656, filed on Dec. 5, 2014, in the Japan Patent Office, the entire disclosure of which is hereby incorporated by reference herein.

BACKGROUND

Technical Field

The present invention relates to an electrophotographic photoreceptor, and an image forming apparatus and a process cartridge using the electrophotographic photoreceptor.

Description of the Related Art

In an image forming method using an electrophotographic image forming apparatus, an image is formed by applying processes such as a charging process, an irradiating process, a developing process and a transferring process to the electrophotographic photoreceptor. Recently, as materials forming the electrophotographic photoreceptor, organic materials are widely used because of having advantages in flexibility, thermostability, film formability, etc.

Image forming apparatuses including electrophotographic photoreceptors using the organic materials rapidly progress in forming full-color images and forming images at high speed, and are being used not only in typical office fields but also in light printing fields which do not need high printing technologies. Since the light printing fields noticeably increase in printing volume (the number of prints needed), the electrophotographic photoreceptor is required to have stable electrical properties such as chargeability and optical attenuation (residual potential), and produce quality images without afterimages and background fouling for long periods.

For the purpose of stabilizing the electrical properties and the image quality of the electrophotographic photoreceptor, a proposal is made on an undercoat layer thereof.

SUMMARY

An electrophotographic photoreceptor, including a substrate; an undercoat layer overlying the substrate; and a photosensitive layer overlying the undercoat layer, wherein the undercoat layer includes a binder resin, a metal oxide particle and a compound having a thiol group.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
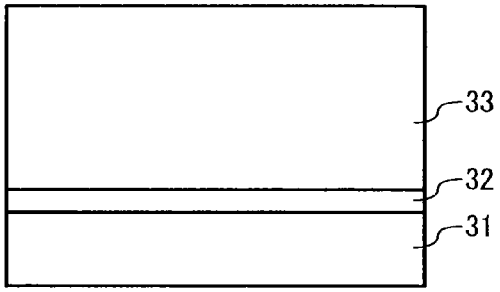
FIG. 1 is a schematic view illustrating an embodiment of layer composition of the electrophotographic photoreceptor of the present invention.

Accordingly, one object of the present invention is to provide an electrophotographic photoreceptor capable of having fully stable electrical properties and producing quality images for long periods even under an environment of high temperature and high humidity or low temperature and low humidity.

Another object of the present invention is to provide an image forming apparatus using the electrophotographic photoreceptor.

A further object of the present invention is to provide a process cartridge using the electrophotographic photoreceptor.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

(Electrophotographic Photoreceptor)

The electrophotographic photoreceptor of the present invention includes at least a substrate, an undercoat layer overlying the substrate and a photosensitive layer overlying the undercoat layer, and other layers when necessary.

The undercoat layer includes materials specified in the present invention, and the substrate, the photosensitive layer and the other layers may be conventional.

<Undercoat Layer>

The undercoat layer includes at least a binder resin, a metal oxide particle and a compound having a thiol group, and other components when necessary.

The undercoat layer preferably has a function that suppresses injection of unnecessary charges (i.e., charges having a polarity opposite to the charging polarity of the photoreceptor) from the substrate into the photosensitive layer, and another function that transports charges generated in the photosensitive layer which have the same polarity as the charging polarity of the photoreceptor. For example, in a case in which the photoreceptor is negatively charged in the image forming process, the undercoat layer preferably has a function that prevents injection of positive holes from the substrate into the photosensitive layer (hereinafter "hole blocking property"), and another function that transports electrons from the photosensitive layer to the substrate (hereinafter "electron transportability"). In a photoreceptor which is stable for an extended period of time, these properties will not change even after repeated exposure to electrostatic loads.

<<Compound Having Thiol Group>>

Specific examples of the compound having a thiol group includes, but are not limited to, a chain-transfer agent having a thiol group.

Specific examples of the chain-transfer agent having a thiol group include 1,2-ethanedithiol, 1,2-cyclohexanedithiol, 1,3,5-tris(3-mercaptobutyryloxyethyl)-1,3,5-triazine-2,4,6(1H,3H,5H)-trione, 1,3-propanedithiol, 1,4-dimethyl mercaptobenzene, 1,4-bis(3-mercaptobutyryloxy)butane, 1,4-butanediolbisthio glycolate, 1,4-butanediol bisthio propionate, 1,4-butanedithiol, 1,6-hexane dithiol, 1,8-octanedithiol, 2-(N,N-dibutyl amino)-4,6-dimercapto-s-triazine, 2,3-dimercapto-1-propanol, 2,4,6-trimercapto-s-triazine, 2-mercapto-4(3H)-quinazoline, 2-mercaptoethanol, 2-mercaptopropionic acid, 2-mercaptobenzimidazole, 2-mercaptobenzo oxazole, 2-mercaptobenzothiazole, 3-mercapto-1,2,4-triazole, 3-mercaptopropionic acid, β-mercaptonaphthalene ethylene bisthio glycolate, ethylene glycol busthio propionate, glycidyl mercaptan, the pentaerythritol hexakis (3-mercapto propionate), dipentaerythritol hexanethiopropionate, thioglycolic acid, thioglycolic acid-2-ethyl hexyl, thioglycolic acid ammonium, thioglycolic acid octyl, thioglycolic acid soda, thioglycolic acid methyl, thioglycolic acid methoxy butyl, thioglycolic acid monoethanolamine, decanedithiol, dodecyl mercaptan (dodecanethiol), trimethylolethane tris(3-mercaptobutylate), trimethylol propane tris(3-mercaptobutylate), trimethylol propane tris(3-mercaptopropionate), trimethylol propane tristhio glycolate, trimethylolpropane tristhiopropionate, trimercaptopropionic acid tris(2-hydroxyethyl)isocyanurate, 1,4-hexanedithiol, pentaerythritol tetrakis(3-mercaptopropionate), pentaerythritol tetrakisthio glycolate, pentaerythritol tetrakisthios propionate, mercaptopropionic acid octyl, mercaptopropionic acid tridecyl, mercaptopropionic acid methyl, mercaptopropionic acid methoxy butyl, mercaptoacetic acid, etc.

These compounds having a thiol group can be used alone or in combination. Among these, compounds having at least two thiol groups are preferably used. 1,3,5-tris(3-mercaptobutyryloxyethyl)-1,3,5-triazine-2,4,6(1H,3H,5H)-trione and 1,4-bis(3-mercaptobutyryloxy)butane are more preferably used.

The content of the compound having a thiol group is preferably from 0.01 to 20 parts by weight, and more preferably from 0.1 to 10 parts by weight per 100 parts by weight of the metal oxide particle in terms of environmental stability of the electrical properties and image quality.

When the content is from 0.01 to 20 parts by weight, not less than 0.01 parts by weight, the electrophotographic photoreceptor can have stable electrical properties and produce image quality even under an environment of severe temperature and humidity. In addition, the compound is difficult to migrate to an upper layer such as a photosensitive layer on the undercoat layer, or dissolve in a coating liquid.

<<Metal Oxide Particle>>

Specific examples of the metal oxide particle include, but are not limited to, particles of titanium oxide, tin oxide, zinc oxide, indium oxide, antimony oxide, ITO (Indium Tin Oxide), etc. These can be used alone or in combination. Among these, the zinc oxide particle is preferably used in terms of volume (powder) resistivity and dispersibility.

The metal oxide particle preferably has an average primary particle diameter not greater than 500 nm, but is not particularly limited thereto.

The average primary particle diameter of the metal oxide particle is determined by calculating an average of a major axis and a minor axis of 10 pieces of the metal oxide particle observed with a scanning electron microscope (SEM) at not less than 50,000 magnifications.

The metal oxide particle preferably has a volume resistivity of from $10^2$ to $10^{11}$ Ω·cm in terms of leak resistance and maintenance of optical attenuation, but is not particularly limited thereto.

When the volume resistivity is $10^2$ to $10^{11}$ Ω·cm, charge injection preventability of the undercoat layer works to give sufficient leak resistance thereto, which reduces abnormal images such as background fouling. In addition, charges are sufficiently transported from the photosensitive layer to the substrate, and the optical attenuation does not deteriorate and the residual potential is difficult to increase.

Specific examples of the binder resin include, but are not limited to, thermoplastic resins and thermosetting resins. These can be used alone or in combination. The binder resin of the undercoat layer preferably has high resistance to organic solvents, in view of the application of the photosensitive layer. Specific examples thereof include a water-soluble resin such as polyvinyl alcohol, casein, and sodium polyacrylate; an alcohol-soluble resin such as copolymerized nylon and methoxymethylated nylon; and a curable resin which forms a three-dimensional network structure, such as polyurethane, melamine resin, phenol resin, alkyd-melamine resin, and epoxy resin; and butyral resins such as polyvinyl butyral.

The content of the binder resin is preferably from 10 to 200 parts by weight, and more preferably from 20 to 100 parts by weight per 100 parts by weight of the metal oxide particle, but is not particularly limited thereto.

<<Other Components>>

The undercoat layer may include other components for the purpose of stabilizing electrical properties and image quality.

Specific examples of such components include, but are not limited to, electron transport materials, polycyclic condensed or azo electron transport pigments, silane coupling agents, zirconium chelate compounds, titanium chelate compounds, aluminum chelate compounds, titanium alkoxide compounds, organic titanium compounds, antioxidants, plasticizers, lubricants, UV absorbers and leveling agents. Two or more of these materials can be used in combination.

<<Undercoat Layer Forming Method>>

Methods of forming the undercoat layer are not particularly limited, and it can be formed using a suitable solvent and a suitable coating method. The binder resin may be added to an undercoat layer coating liquid before or after the metal oxide is added thereto.

Specific examples of the solvent include, but are not limited to, an alcohol such as methanol, ethanol, propanol, and butanol; a ketone such as acetone, methyl ethyl ketone, methyl isobutyl ketone, and cyclohexanone; an ester such as ethyl acetate and butyl acetate; an ether such as tetrahydrofuran, dioxane, and propyl ether; a halogen-based solvent such as dichloromethane, dichloroethane, trichloroethane, and chlorobenzene; an aromatic solvent such as benzene, toluene, and xylene; and a cellosolve such as methyl cellosolve, ethyl cellosolve, and cellosolve acetate. Two or more of these solvents can be used in combination.

Methods of dispersing the metal oxide particle in the undercoat layer coating liquid are not particularly limited, and dispersion methods using ball mills, sand mills, vibration mills, KD mills, three-roll mills, attritors, pressure-type homogenizers, ultrasonic dispersers, etc. can be used.

A method of applying the undercoat layer coating liquid is not limited to any particular method, and is determined depending on the viscosity of the undercoat layer coating liquid, a desired average thickness of the undercoat layer, etc. Specific examples of the application method include, but are not limited to, a dipping method, a spray coating method, a bead coating method, and a ring coating method.

The undercoat layer coating liquid having been applied can be heat-dried with an oven, etc., when necessary. The drying temperature is determined depending on the type of the solvent included in the undercoat layer coating liquid, and is preferably from 80° C. to 200° C. and more preferably from 100° C. to 150° C.

The average thickness of the undercoat layer is determined depending on the desired electric properties or lifespan of the electrophotographic photoreceptor, and is preferably from 3 to 35 μm, and more preferably from 5 to 30 μm in terms of maintaining chargeability and optical attenuation.

When the average thickness of the undercoat layer is from 3 to 35 μm, charges having a polarity opposite to the charging polarity of the electrophotographic photoreceptor are not injected from the substrate to the photosensitive layer, which is difficult to cause defective images having background fouling due to poor chargeability. Further, the optical attenuation may not deteriorate due to increase of residual potential and repetitive stability may not deteriorate.

The average thickness can be measured by measuring thicknesses of random plural points of the undercoat layer to average them. The average of 5 points is preferably, 10 points more preferably, 20 points furthermore preferably used.

A micrometer can measure the average thickness.

<Photosensitive Layer>

The photosensitive layer may be either a multi-layer photosensitive layer or a single-layer photosensitive layer.

<<Multi-Layer Photosensitive Layer>>

In the multi-layer photosensitive layer, a charge generation function and a charge transport function are provided from independent layers. Accordingly, the multi-layer photosensitive layer has a charge generation layer and a charge transport layer.

In the multi-layer photosensitive layer, the stacking sequence of the charge generation layer and charge transport layer is not limited. Generally, most charge generation materials are poor in chemical stability and cause deterioration in charge generation efficiency when exposed to an acid gas, such as a discharge product generated around a charger in an electrophotographic apparatus. Therefore, it is preferable that the charge transport layer is overlaid on the charge generation layer.

—Charge Generation Layer—

The charge generation layer includes at least a charge generation material and a binder resin, and optionally other components, when necessary.

—Charge Generation Material—

Specific examples of the charge generation material include, but are not limited to, an inorganic material and an organic material.

—Inorganic Material—

Specific examples of the inorganic material include, but are not limited to, crystalline selenium, amorphous selenium, selenium-tellurium compounds, selenium-tellurium-halogen compounds, selenium-arsenic compounds, and amorphous silicon (e.g., those in which dangling bonds are terminated with hydrogen atom, halogen atom, etc.; or doped with boron atom, phosphor atom, etc.).

—Organic Material—

Specific examples of the organic material include, but are not limited to, phthalocyanine pigments such as metal phthalocyanine and metal-free phthalocyanine; azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene pigments, anthraquinone or polycyclic quinone pigments, quinoneimine pigments, diphenylmethane and triphenylmethane pigments, benzoquinone and naphthoquinone pigments, cyanine and azomethine pigments, indigoid pigments, and bisbenzimidazole pigments. Two or more of these materials can be used in combination.

—Binder Resin—

Specific examples of the binder resin include, but are not limited to, polyamide resin, polyurethane resin, epoxy resin, polyketone resin, polycarbonate resin, silicone resin, acrylic resin, polyvinyl butyral resin, polyvinyl formal resin, polyvinyl ketone resin, polystyrene resin, poly-N-vinylcarbazole resin, and polyacrylamide resin. Two or more of these resins can be used in combination.

Specific examples of the binder resin further include charge transport polymers having a charge transport function, such as polymers (e.g., polycarbonate, polyester, polyurethane, polyether, polysiloxane) having an aryl skeleton, a benzidine skeleton, a hydrazone skeleton, a carbazole skeleton, a stilbene skeleton, a pyrazoline skeleton, etc.; and polymers having a polysilane skeleton.

—Other Components—

Specific examples of the other components include, but are not limited to, a low-molecular-weight charge transport material, a solvent, a leveling agent, and an antioxidant.

The content of the other components is preferably form 0.01% to 10% by mass based on total mass of the layer.

Low-Molecular-Weight Charge Transport Material

Specific examples of the low-molecular-weight charge transport material include, but are not limited to, an electron transport material and a hole transport material.

Specific examples of the electron transport material include, but are not limited to, chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives. Two or more of these materials can be used in combination.

Specific examples of the hole transport material include, but are not limited to, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. Two or more of these materials can be used in combination.

—Solvent—

Specific examples of the solvent include, but are not limited to, tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, and butyl acetate. Two or more of these solvents can be used in combination.

—Method of Forming Charge Generation Layer—

A method of forming the charge generation layer may include, for example, dissolving or dispersing the charge generation material and the binder resin in the other component, such as the solvent, to prepare a coating liquid, applying the coating liquid on the substrate, and drying the coating liquid. The coating liquid can be applied by, for example, a casting method.

The average thickness of the charge generation layer is preferably from 0.01 to 5 μm, and more preferably from 0.05 to 2 μm.

—Charge Transport Layer—

The charge transport layer has a function of retaining charges and another function of transporting charges generated in the charge generation layer upon light exposure to make them bind the charges retained in the charge transport layer. In order to retain charges, the charge transport layer is required to have a high electric resistance. Additionally, in order to achieve a high surface potential with the retaining charges, the charge transport layer is required to have a small permittivity and good charge mobility.

The charge transport layer includes at least a charge transport material and a binder resin, and other components when necessary.

—Charge Transport Material—

Specific examples of the charge transport material include, but are not limited to, an electron transport material, a positive hole transport material, and a polymeric charge transport material.

The content of the charge transport material is preferably from 20% to 80% by mass, more preferably from 30% to 70% by mass, based on total mass of the charge transport layer.

When the content is from 20% to 80%, the charge mobility in the charge transport layer is not so small that a desired optical attenuation may be obtained. In addition, the charge transport layer may not become excessively worn by various hazards to which the photoreceptor has been exposed in an image forming process.

Further, when the content of the charge transport material in the charge transport layer is from 30% to 70% by mass, desired optical attenuation can be obtained with a smaller amount of wear of the photoreceptor.

—Electron Transport Material—

Specific examples of the electron transport material (electron-accepting material) include, but are not limited to, chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, and 1,3,7-trinitrodibenzothiophene-5,5-dioxide. Two or more of these materials can be used in combination.

—Positive Hole Transport Material—

Specific examples of the positive hole transport material (electron-donating material) include, but are not limited to, oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Two or more of these materials can be used in combination.

—Polymeric Charge Transport Material—

The polymeric charge transport material has both a function of binder resin and a function of charge transport material.

Specific examples of the polymeric charge transport material include, but are not limited to, polymers having a carbazole ring, polymers having a hydrazone structure, polysilylene polymers, polymers having a triarylamine structure (e.g., described in JP-3852812-B and JP-3990499-B), and polymers having an electron-donating group. Two or more of these materials can be used in combination. Below-described binder resins can also be used in combination for improving abrasion resistance and film formation property.

The content of the polymeric charge transport material is preferably from 40% to 90% by mass, more preferably from 50% to 80% by mass, based on total mass of the charge transport layer, when the polymeric charge transport material and the binder resin are used in combination.

—Binder Resin—

Specific examples of the binder resin include, but are not limited to, polycarbonate resin, polyester resin, methacrylic resin, acrylic resin, polyethylene resin, polyvinyl chloride resin, polyvinyl acetate resin, polystyrene resin, phenol resin, epoxy resin, polyurethane resin, polyvinylidene chloride resin, alkyd resin, silicone resin, polyvinyl carbazole resin, polyvinyl butyral resin, polyvinyl formal resin, polyacrylate resin, polyacrylamide resin, and phenoxy resin. Two or more of these resins can be used in combination.

The charge transport layer may further include a copolymer of a cross-linkable binder resin with a cross-linkable charge transport material.

—Other Components—

Specific examples of the other components include, but are not limited to, a solvent, a plasticizer, a leveling agent, and an antioxidant.

The content of the other components is preferably form 0.01% to 10% by mass based on total mass of the layer.

—Solvent—

Specific examples of the solvent include, but are not limited to, those usable for the charge generation layer. In particular, those capable of well dissolving the charge transport material and the binder resin are preferable. Two or more of such solvents can be used in combination.

—Plasticizer—

Specific examples of the plasticizer include, but are not limited to, dibutyl phthalate and dioctyl phthalate, which are general plasticizer for resins.

—Method of Forming Charge Transport Layer—

A method of forming the charge transport layer may include, for example, dissolving or dispersing the charge transport material and the binder resin in the other component, such as the solvent, to prepare a coating liquid, applying the coating liquid on the charge generation layer, and heating or drying the coating liquid.

A method of applying the charge transport layer coating liquid is not limited to any particular method, and is determined depending on the viscosity of the coating liquid, a desired average thickness of the charge transport layer, etc. Specific examples of the application method include, but are not limited to, a dipping method, a spray coating method, a bead coating method, and a ring coating method.

In view of electrophotographic properties and film viscosity, the solvent should be removed from the charge transport layer by means of heating.

The heating may be performed by, for example, heating the charge transport layer from the coated surface side or the substrate side with heat energy such as a gas (e.g., the air, nitrogen), a vapor, a heat medium, infrared ray, and electromagnetic wave.

The heating temperature is preferably from 100° C. to 170° C.

When the heating temperature is from 100° C. to 170° C., the solvent can be completely removed from the layer and electrophotographic properties and abrasion durability may not deteriorate. Further, orange-peel-like defects or cracks may not appear on the surface, and the layer may not detach from adjacent layers. Furthermore, in a case in which volatile components in the photosensitive layer are atomized, desired electric properties can be obtained.

The average thickness of the Charge transport layer is preferably 50 μm or less, and more preferably 45 μm or less, in terms of resolution and responsiveness, but is not limited thereto. The lower limit of the average thickness is preferably 5 μm or more, but it depends on the system (in particular, charge potential) in use.

<<Single-Layer Photosensitive Layer>>

The single-layer photosensitive layer has both a charge generation function and a charge transport function.

The single-layer photosensitive layer includes at least a charge generation material, a charge transport material, and a binder resin, and other components when necessary.

—Charge Generation Material—

Specific examples of the charge generation material include, but are not limited to, those for use in the multi-layer photosensitive layer to be described later. The content of the charge generation material is preferably from 5 to 40 parts by mass based on 100 parts by mass of the binder resin.

—Charge Transport Material—

Specific examples of the charge transport material include, but are not limited to, those for use in the multi-layer photosensitive layer to be described later. The content of the charge transport material is preferably 190 parts by mass or less, more preferably from 50 to 150 parts by mass, based on 100 parts by mass of the binder resin.

—Binder Resin—

Specific examples of the binder resin include, but are not limited to, those for use in the multi-layer photosensitive layer to be described later.

—Other Components—

Specific examples of the other components include, but are not limited to, those for use in the multi-layer photosensitive layer, such as a low-molecular-weight charge transport material, a solvent, an antioxidant, a plasticizer, a lubricant, an UV absorber and a leveling agent and an antioxidant.

—Method of Forming Single-Layer Photosensitive Layer—

A method of forming the single-layer photosensitive layer may include, for example, dissolving or dispersing the charge generation material, charge transport material, binder resin, and other components in a solvent (e.g., tetrahydrofuran, dioxane, dichloroethane, cyclohexane) with a disperser to prepare a coating liquid, and applying and drying the coating liquid.

A method of applying the coating liquid may be, for example, a dipping method, a spray coating method, a bead coating method, or a ring coating method. The single-layer photosensitive layer may further include additives such as a plasticizer, a leveling agent and an antioxidant when necessary.

The average thickness of the single-layer photosensitive layer is preferably from 5 to 25 μm, but is not limited thereto.

<Substrate>

The substrate is not limited to any particular material so long as it is a conductive body having a volume resistivity of $1\times10^{10}$ Ω·cm or less. For example, endless belts (e.g., an endless nickel belt, an endless stainless-steel belt) disclosed in JP-S52-36016-B can be used as the substrate.

The substrate can be formed by, for example, covering a substrate body (e.g., a plastic film, a plastic cylinder, a paper sheet) with a metal (e.g., aluminum, nickel, chromium, nichrome, copper, gold, silver, platinum) or a metal oxide (e.g., tin oxide, and indium oxide) by means of vapor deposition or sputtering; or subjecting a plate of a metal (e.g., aluminum, aluminum alloy, nickel, stainless steel) to an extruding or drawing process and then subjecting the resulting tube to a surface treatment (e.g., cutting, super finishing, polishing).

The substrate may have a conductive layer on its surface.

The conductive layer can be formed by, for example, applying a coating liquid, obtained by dispersing or dissolving a conductive powder and a binder resin in a solvent, to the substrate; or using a heat-shrinkable tube which is dispersing a conductive powder in a material such as polyvinyl chloride, polypropylene, polyester, polystyrene, polyvinylidene chloride, polyethylene, chlorinated rubber, and TEFLON (trademark).

Specific examples of the conductive powder include, but are not limited to, carbon particles such as carbon black and acetylene black; powders of metals such as aluminum, nickel, iron, nichrome, copper, zinc, and silver; and powders of metal oxides such as conductive tin oxide and ITO.

Specific examples of the binder resin for use in the conductive layer include, but are not limited to, thermoplastic, thermosetting, and photo-curable resins, such as polystyrene resin, styrene-acrylonitrile copolymer, styrene-butadiene copolymer, styrene-maleic anhydride copolymer, polyester resin, polyvinyl chloride resin, vinyl chloride-vinyl acetate copolymer, polyvinyl acetate resin, polyvinylidene chloride resin, polyarylate resin, phenoxy resin, polycarbonate resin, cellulose acetate resin, ethyl cellulose resin, polyvinyl butyral resin, polyvinyl formal resin, polyvinyl toluene resin, poly-N-vinylcarbazole, acrylic resin, silicone resin, epoxy resin, melamine resin, urethane resin, phenol resin, and alkyd resin.

Specific examples of the solvent for use in forming the conductive layer include, but are not limited to, tetrahydrofuran, dichloromethane, methyl ethyl ketone, and toluene.

<Other Layers>

Specific examples of the other layers include, but are not limited to, a protective layer, an intermediate layer and a second undercoat layer.

<<Protective Layer>>

The protective layer (surface layer) can be formed on the photosensitive layer for the purpose of improving durability and other functions of the electrophotographic photoreceptor. The protective layer includes at least a binder resin and a filler, and other components when necessary.

—Binder Resin—

Specific examples of the binder resin include, but are not limited to, ABS resin, ACS resin, olefin-vinyl monomer copolymer, chlorinated polyether, aryl resin, phenol resin, polyacetal, polyamide, polyamide-imide, polyacrylate, polyarylsulfone, polybutylene, polybutylene terephthalate, polycarbonate, polyethersulfone, polyethylene, polyethylene terephthalate, polyimide, acrylic resin, polymethylpentene, polypropylene, polyphenylene oxide, polysulfone, polystyrene, polyacrylate, AS resin, butadiene-styrene copolymer, polyurethane, polyvinyl chloride, polyvinylidene chloride, and epoxy resin. Two or more of these materials can be used in combination. Among these materials, polycarbonate and polyarylate are preferable in view of filler dispersibility, residual potential, and coated film defect.

—Filler—

Specific examples of the filler include, but are not limited to, metal oxide particles.

Specific examples of the metal oxide include, but are not limited to, particles of aluminum oxide, zinc oxide, titanium oxide, tin oxide, antimony oxide, indium oxide, bismuth oxide, indium oxide doped with tin, tin oxide doped with antimony or tantalum and zirconium oxide doped with antimony. These can be used alone or in combination.

A method of forming the protective layer may be using a suitable solvent and suitable a coating method as the method of forming the photosensitive layer, such as a dipping method, a spray coating method, a bead coating method, a nozzle coating method, a spinner coating method, or a ring coating method.

Specific examples of usable solvents for the protective layer coating liquid include, but are not limited to, those usable for the charge transport layer coating liquid, such as tetrahydrofuran, dioxane, toluene, dichloromethane, monochlorobenzene, dichloroethane, cyclohexanone, methyl ethyl ketone, and acetone.

At the time of dispersing the coating liquid, a high-viscosity solvent is preferred. At the time of applying the coating liquid, a high-volatility solvent is preferred. If no solvent satisfies the above preferences, two or more types of solvents having different properties can be used in combination, which may have great effect on filler dispersibility and residual potential.

The charge transport material used in the charge transport layer is effectively included in the protective layer to decrease residual potential and improve image quality.

The average thickness of the protective layer is preferably from 1 to 5 μm in terms of abrasion resistance.

—Intermediate Layer—

The intermediate layer can be formed between the charge transport layer and the protective layer, for the purpose of suppressing charge transport layer components being mixed into the protective layer or improving adhesiveness between the two layers.

The intermediate layer includes at least a binder resin and other components such as an antioxidant when necessary. Preferably, the intermediate layer coating liquid is insoluble or poorly-soluble in the protective layer coating liquid.

Specific examples of the binder resin in the intermediate layer include, but are not limited to, polyamide, alcohol-soluble nylon, polyvinyl butyral, and polyvinyl alcohol.

The intermediate layer can be formed in the same manner as the photosensitive layer is formed.

The average thickness of the intermediate layer is preferably from 0.05 to 2 μm.

<<Second Undercoat Layer>>

The second undercoat layer can be formed between the photosensitive layer and the protective layer. The second undercoat layer includes at least a second binder resin and other components when necessary.

Specific examples of the second binder resin in the intermediate layer include, but are not limited to, polyamide, alcohol-soluble nylon, polyvinyl butyral, and polyvinyl alcohol.

The intermediate layer can be formed using a suitable solvent and a suitable coating method.

The average thickness of the second undercoat layer is preferably from 0.05 to 2 μm.

In the electrophotographic photoreceptor of the present invention, for the purpose of preventing sensitivity decrease and residual potential increase, the charge generation layer, charge transport layer, undercoat layer, protective layer and the second undercoat layer may include other components such as an antioxidant, a plasticizer, a lubricant, an ultraviolet ray absorber and a leveling agent.

Embodiments of Electrophotographic Photoreceptor

Embodiments of the electrophotographic photoreceptor of the present invention are explained.

First Embodiment

FIG. 1 is a schematic view illustrating an embodiment of layer composition of the electrophotographic photoreceptor of the present invention.

The electrophotographic photoreceptor illustrated in FIG. 1 has a single-layer photosensitive layer. This electrophotographic photoreceptor includes, from the innermost side thereof, a support 31, an undercoat layer 32 containing zinc oxide particles and a binder resin, and a single-layer photosensitive layer 33.

Second Embodiment

Figure 2:
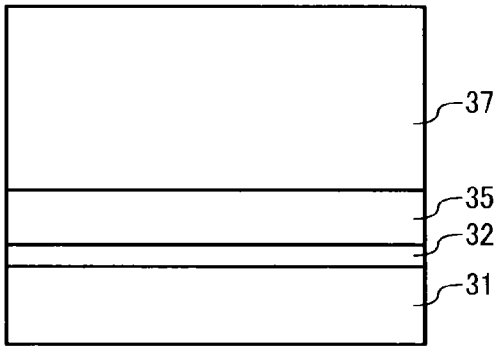
FIG. 2 is a schematic view illustrating another embodiment of layer composition of the electrophotographic photoreceptor of the present invention.

FIG. 2 is a schematic view illustrating another embodiment of layer composition of the electrophotographic photoreceptor of the present invention.

The electrophotographic photoreceptor illustrated in FIG. 2 has a multi-layer photosensitive layer. This electrophotographic photoreceptor includes, from the innermost side thereof, a support 31, an undercoat layer 32 containing zinc oxide particles and a binder resin, a charge generation layer 35, and a charge transport layer 37. The charge generation layer 35 and the charge transport layer 37 correspond to the photosensitive layer.

Third Embodiment

Figure 3:
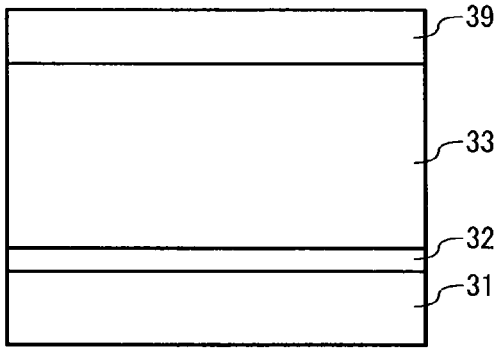
FIG. 3 is a schematic view illustrating a further embodiment of layer composition of the electrophotographic photoreceptor of the present invention.

FIG. 3 is a schematic view illustrating a further embodiment of layer composition of the electrophotographic photoreceptor of the present invention.

The electrophotographic photoreceptor illustrated in FIG. 3 has a single-layer photosensitive layer. This electrophotographic photoreceptor includes, from the innermost side thereof, a support 31, an undercoat layer 32 containing zinc oxide particles and a binder resin, a single-layer photosensitive layer 33, and a protective layer 39.

Fourth Embodiment

Figure 4:
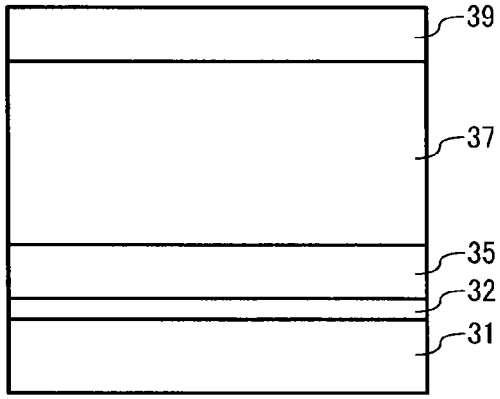
FIG. 4 is a schematic view illustrating another embodiment of layer composition of the electrophotographic photoreceptor of the present invention.

FIG. 4 is a schematic view illustrating another embodiment of layer composition of the electrophotographic photoreceptor of the present invention The electrophotographic photoreceptor illustrated in FIG. 4 has a multi-layer photosensitive layer. This electrophotographic photoreceptor includes, from the innermost side thereof, a support 31, an undercoat layer 32 containing zinc oxide particles and a binder resin, a charge generation layer 35, and a charge transport layer 37, and a protective layer 39. The charge generation layer 35 and the charge transport layer 37 correspond to the photosensitive layer.

(Image Forming Apparatus and Image Forming Method)

The image forming apparatus of the present invention includes at least the electrophotographic photoreceptor of the present invention, a charger charging the surface of the electrophotographic photoreceptor, an irradiator irradiating the charged surface thereof to an electrostatic latent image thereon, an image developer developing the electrostatic latent image with a toner to form a visible image and a transferer transferring the visible image onto a recording medium, and other means when necessary. The charger and irradiator may be hereinafter collectively referred to as an electrostatic latent image former.

The image forming method of the present invention includes at least a charging process charging the surface of the electrophotographic photoreceptor of the present invention, an irradiation process irradiating the charged surface thereof to an electrostatic latent image thereon, a developing process developing the electrostatic latent image with a toner to form a visible image and a transfer process transferring the visible image onto a recording medium, and other processes when necessary.

The charging and irradiation processes may be hereinafter collectively referred to as an electrostatic latent image forming process.

<Charger and Charging Process>

Specific examples of the charger include, but are not limited to, a contact charger equipped with a conductive or semiconductive roller, brush, film, or rubber blade, and a non-contact charger (including a proximity non-contact charger having a gap distance of 100 μm or less between a surface of the electrophotographic photoreceptor and the charger) employing corona discharge such as corotron and scorotron.

Preferably, the charger has a charging member in contact with or proximity to a surface of the electrophotographic photoreceptor, and applies a voltage in which an alternating current component is superimposed on a direct current component to the charging member to cause corona discharge between the charging member and the surface of the electrophotographic photoreceptor.

The charging process can be performed by the charger, and is a process of charging a surface of the electrophotographic photoreceptor.

<Irradiator and Irradiation Process>

The irradiator is not limited in configuration so long as it can irradiate the charged surface of the electrophotographic photoreceptor with light containing image information. Specific examples of the irradiator include, but are not limited to, various irradiators of radiation optical system type, rod lens array type, laser optical type, liquid crystal shutter optical type, and LED optical system type. Specific examples of light sources for use in the irradiator include, but are not limited to, those providing a high luminance, such as light-emitting diode (LED), laser diode (LD), and electroluminescence (EL). The irradiation process can also be performed by irradiating the back surface of the electrophotographic photoreceptor with light containing image information.

The irradiation process can be performed by the irradiator, and is a process of irradiating the charged surface of the electrophotographic photoreceptor with light to form an electrostatic latent image.

<Image Developer and Developing Process>

The image developer is not limited in configuration so long as it can develop the electrostatic latent image with toner or developer. For example, an image developer capable of storing a developer and supplying the developer to the electrostatic latent image either by contact therewith or without contact therewith is preferable. The image developer may employ either a dry developing method or a wet developing method. The image developer may employ either a single-color image developer or a multi-color image developer. For example, an image developer which has a stirrer for frictionally charging the developer and a rotatable magnet roller is preferable. In the image developer, toner particles and carrier particles are mixed and stirred, and the toner particles are charged by friction. The charged toner particles and carrier particles are formed into ear-like aggregation and retained on the surface of the magnet roller that is rotating, thus forming a magnetic brush. Because the magnet roller is disposed adjacent to the electrophotographic photoreceptor, a part of the toner particles composing the magnetic brush formed on the surface of the magnet roller migrate to the surface of the electrophotographic photoreceptor by an electric attractive force. As a result, the electrostatic latent image is developed with the toner particles to form a visible image on the surface of the electrophotographic photoreceptor.

The developing process can be performed by the image developer, and is a process of developing the electrostatic latent image into a visible image with toner.

<Transferer and Transfer Process>

The transferer is a means for transferring the visible image onto a recording medium. The transferer may employ either a direct transfer method which involves directly transferring the visible image from the surface of the electrophotographic photoreceptor onto a recording medium, or a secondary transfer method which involves primarily transferring the visible image onto an intermediate transfer medium and secondarily transferring the visible image on a recording medium. In a case in which transfer process itself is considered to adversely affect image quality, the former (i.e., the direct method) is preferable because exposure to transfer processes is less frequent.

The transfer process can be performed by the transferer, and is a process of transferring the visible image onto a recording medium.

<Other Means and Other Processes>

The other means and other processes may include, for example, a fixer and a fixing process; a neutralizer and a neutralization process; a cleaner and a cleaning process; a recycler and a recycle process; and a controller and a control process.

—Fixer and Fixing Process—

The fixer preferably includes a heat-pressure member. Specific examples of the heat-pressure member include, but are not limited to, a combination of a heat roller and a pressure roller; and a combination of a heat roller, a pressure roller, and an endless belt. The heating temperature is preferably from 80° C. to 200° C. The fixing process may be performed either every time each color toner image is transferred onto the recording medium or at once after all color toner images are superimposed on one another.

The fixing process can be performed by the fixer, and is a process of fixing the transferred image on the recording medium.

—Neutralizer and Neutralization Process—

The neutralizer is not limited in configuration so long as it can apply a neutralization bias to the electrophotographic photoreceptor. Specific examples of the neutralizer include, but are not limited to, a neutralization lamp.

The neutralization process can be performed by the neutralizer, and is a process of neutralizing the electrophotographic photoreceptor by application of a neutralization bias thereto.

—Cleaner and Cleaning Process—

The cleaner is not limited in configuration so long as it can remove residual toner particles remaining on the electrophotographic photoreceptor. Specific examples of the cleaner include, but are not limited to, magnetic brush cleaner, electrostatic brush cleaner, magnetic roller cleaner, blade cleaner, brush cleaner, and web cleaner.

The cleaning process can be performed by the cleaner, and is a process of removing residual toner particles remaining on the electrophotographic photoreceptor.

—Recycler and Recycle Process—

Specific examples of the recycler include, but are not limited to, a conveyor.

The recycle process can be performed by the recycler, and is a process of recycling the toner particles removed in the cleaning process in the developing device.

—Controller and Control Process—

The controller is not limited in configuration so long as it can control the above-described processes. Specific examples of the controller include, but are not limited to, a sequencer and a computer.

The control process can be performed by the controller, and is a process of controlling the above-described processes.

Embodiment of Image Forming Apparatus

Figure 5:
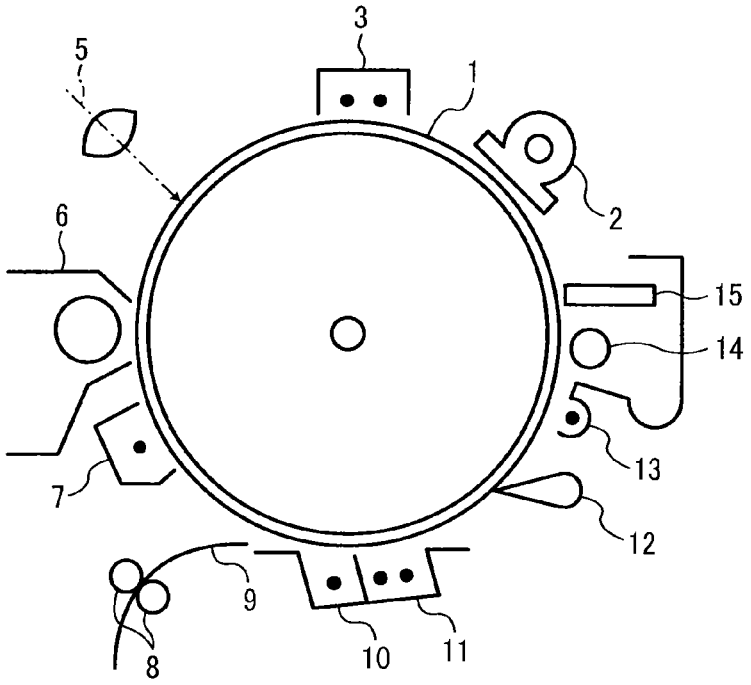
FIG. 5 is a schematic view illustrating an embodiment of the image forming apparatus of the present invention.

FIG. 5 is a schematic view illustrating an embodiment of the image forming apparatus of the present invention. The image forming apparatus includes an electrophotographic photoreceptor 1; and a charger 3, an irradiator 5, a developing device 6, and a transfer device 10 disposed around the electrophotographic photoreceptor 1 rotating anticlockwise therein.

First, the charger 3 uniformly charges the electrophotographic photoreceptor 1. Specific examples of the charger 3 include, but are not limited to, a corotron device, a scorotron device, a solid-state discharging element, a needle electrode device, a roller charging device, and a conductive brush device.

Next, the irradiator 5 forms an electrostatic latent image on the uniformly-charged electrophotographic photoreceptor 1. Specific examples of light sources for use in the irradiator 5 include, but are not limited to, all luminous matters such as fluorescent lamp, tungsten lamp, halogen lamp, mercury lamp, sodium-vapor lamp, light-emitting diode (LED), laser diode (LD), and electroluminescence (EL). For the purpose of emitting light having a desired wavelength only, any type of filter can be used such as sharp cut filter, band pass filter, near infrared cut filter, dichroic filter, interference filter, and color-temperature conversion filter.

Next, the developing device 6 develops the electrostatic latent image formed on the electrophotographic photoreceptor 1 into a toner image that is visible. Developing method may be either a dry developing method using a dry toner, such as one-component developing method and two-component developing method; or a wet developing method using a wet toner. When the electrophotographic photoreceptor 1 is positively (or negatively) charged and irradiated with light containing image information, a positive (or negative) electrostatic latent image is formed thereon. When the positive (or negative) electrostatic latent image is developed with a negative-polarity (or positive-polarity) toner, a positive image is produced. By contrast, when the positive (or negative) electrostatic latent image is developed with a positive-polarity (or negative-polarity) toner, a negative image is produced.

Next, the transfer device 10 transfers the toner image from the electrophotographic photoreceptor 1 onto a recording medium 9. For the purpose of improving transfer efficiency, a pre-transfer charger 7 may be used. The transfer device 10 may employ an electrostatic transfer method that uses a transfer charger or a bias roller; a mechanical transfer method such as adhesive transfer method and pressure transfer method; or a magnetic transfer method.

As means for separating the recording medium 9 from the electrophotographic photoreceptor 1, a separation charger 11 and a separation claw 12 may be used, if necessary. The separation may also be performed by means of electrostatic adsorption induction separation, side-end belt separation, leading-end grip conveyance, curvature separation, etc. As the separation charger 11, the above-described charger can be used. For the purpose of removing residual toner particles remaining on the electrophotographic photoreceptor 1 without being transferred, cleaners such as a fur brush 14 and a cleaning blade 15 may be used. For the purpose of improving cleaning efficiency, a pre-cleaning charger 13 may be used. The cleaning may also be performed by a web-type cleaner, a magnetic-brush-type cleaner, etc. Such cleaners can be used alone or in combination. For the purpose of removing residual latent image on the electrophotographic photoreceptor 1, a neutralizer 2 may be used. Specific examples of the neutralizer 2 include, but are not limited to, a neutralization lamp and a neutralization charger. As the neutralization lamp and the neutralization charger, the above-described light source and charger can be used, respectively. Processes which are performed not in the vicinity of the photoreceptor, such as document reading, paper feeding, fixing, paper ejection, can be performed by known means.

The above-mentioned charger, irradiator, image developer, the transferer can be fixedly installed in an image forming apparatus such as copiers, printers and facsimiles, and may be installed therein in the form of a process cartridge.

(Process Cartridge)

The process cartridge of the present invention includes at least the electrophotographic photoreceptor of the present invention; and at least one of a charger to charge a surface of the electrophotographic photoreceptor, an irradiator to irradiate the charged surface of the electrophotographic photoreceptor with light to form an electrostatic latent image thereon, a developing device to develop the electrostatic latent image into a visible image with toner, and a transfer device to transfer the visible image onto a recording medium.

Embodiment of Process Cartridge

An embodiment of the process cartridge of the present invention is explained.

Figure 6:
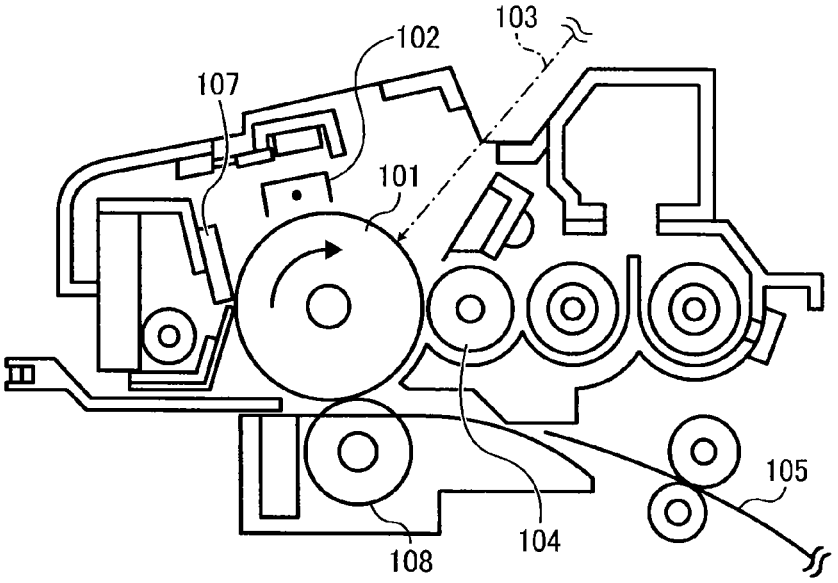
FIG. 6 is a schematic view illustrating an embodiment of the process cartridge of the present invention.

FIG. 6 is a schematic view illustrating an embodiment of the process cartridge of the present invention.

This process cartridge includes an electrophotographic photoreceptor 101, a charger 102, a developing device 104, a transfer device 108, a cleaner 107, and a neutralizer. The process cartridge is detachably mountable on image forming apparatus. In an image forming process, the photoreceptor 101 rotates in a direction indicated by arrow in FIG. 10. A surface of the photoreceptor 101 is charged by the charger 102 and irradiated with light emitted from an irradiator 103.

Thus, an electrostatic latent image is formed on the surface of the photoreceptor 101. The electrostatic latent image is developed into a toner image by the developing device 104. The toner image is transferred onto a recording medium 105 by the transfer device 108. The recording medium 105 having the toner image thereon is printed out. After the image transfer, the surface of the photoreceptor 101 is cleaned by the cleaner 107 and neutralized by the neutralizer. These operations are repeatedly performed.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

Preparation of Undercoat Layer Coating Liquid

The following materials were stirred by a vibration mill filled with zirconia beads having a diameter of 0.5 mm at 1,500 rpm for 6 hrs to prepare an undercoat layer coating liquid.

| | |
|---|---|
| Metal oxide particle: Zinc oxide particle (MZ-300 from Tayca Corp.) | 350 |
| Compound having a thiol group 1,3,5-tris(3-mercaptobutyryloxyethyl)-1,3,5-triazine-2,4,6(1H,3H,5H)-trione (Karenz MT ™ NR1 from SHOWA DENKO K.K.) | 1.5 |
| Binder resin: | |
| Blocked isocyanate (having 75% by mass of solid contents, SUMIDUR ® 3175 from Sumika Bayer Urethane Co., Ltd.) | 60 |
| 20% 2-Butanone-diluted solution of a butyral resin (BM-1 from Sekisui Chemical Co., Ltd.) | 225 |
| Solvent: 2-Butanone | 365 |

<Preparation of Charge Generation Layer Coating Liquid>

The following materials were stirred by a bead mill filled glass beads having a diameter of 1 mm for 8 hrs to prepare a charge generation layer coating liquid.

| | |
|---|---|
| Charge generation material: Titanyl phthalocyanine | 8 |

Figure 7:
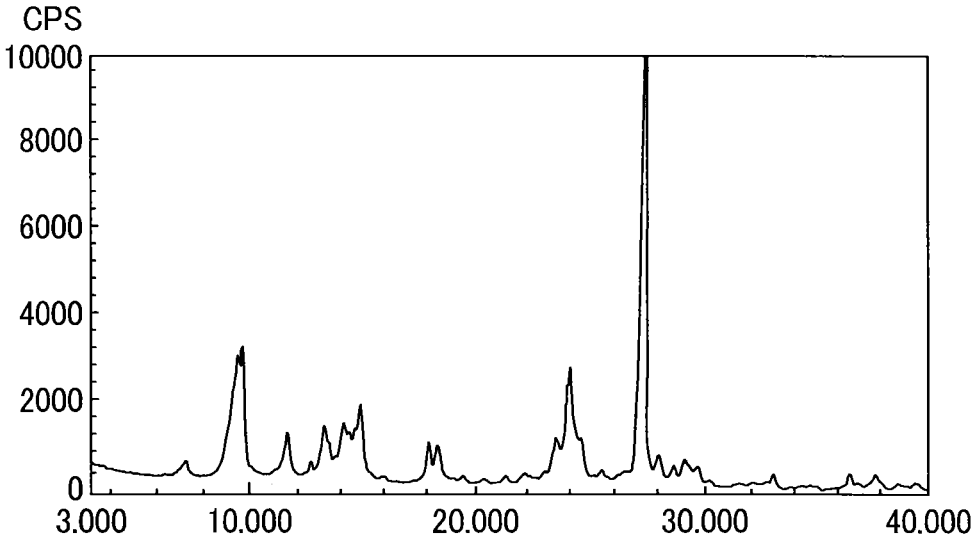
FIG. 7 is an X-ray diffraction spectrum of titanyl phthalocyanine used as a charge generation material in Examples, in which a vertical axis represents counts per second and a horizontal axis represents an angle (2θ).

A powder X-ray diffraction spectrum of the titanyl phthalocyanine is shown in FIG. 7. As an X-ray diffractometer, RINT TTRII from Rigaku Corp. was used.

[X-Ray Diffraction Measurement Conditions]
Bulb: Cu
5 Voltage: 50 kV
Current: 30 mA
Scan speed: 2°/mm
Scan range: 3 to 40°
Time constant: 2 sec

| | |
|---|---|
| Binder resin: Polyvinyl butyral (S-LEC BX-1 from Sekisui Chemical Co., Ltd.) | 5 |
| 2-Butanone | 400 |

<Preparation of Charge Transport Layer Coating Liquid>

The following materials were mixed and stirred until all the materials are dissolved to prepare a charge transport layer coating liquid.

| | |
|---|---|
| Charge transport material having the formula (1) | 9 |

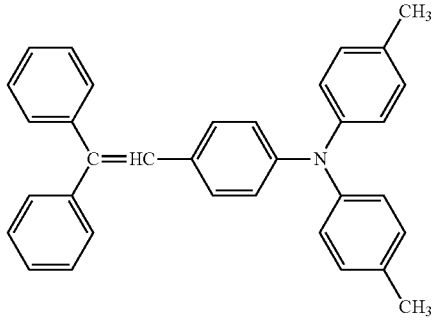

(1)

| | |
|---|---|
| Binder resin: Polycarbonate (TS-2050 from Teijin Chemicals Ltd.) | 10 |
| Leveling agent: Silicone oil (KF-50 from Shin-Etsu Chemical Co., Ltd.) | 0.0005 |
| Solvent: Tetrahydrofuran | 100 |

<Preparation of Electrophotographic Photoreceptor>

The undercoat layer coating liquid was applied to an aluminum cylinder having a diameter of 100 mm by a dipping method and dried at 170° C. for 30 min to from an undercoat layer having an average thickness of 5 μm on the cylinder.

Next, the charge generation layer coating liquid was applied to the undercoat layer by a dipping method and dried at 90° C. for 30 min to form a charge generation layer having an average thickness of 0.2 μm on the undercoat layer.

Further, the charge transport layer coating liquid was applied to the charge generation layer by a dipping method and dried at 150° C. for 30 min to form a charge transport layer having an average thickness of 35 μm on the charge generation layer. Thus, an electrophotographic photoreceptor of Example 1 was prepared.

Example 2

The procedure for preparation of the electrophotographic photoreceptor in Example 1 was repeated except for changing the average thickness of the undercoat layer to 10 μm to prepare an electrophotographic photoreceptor of Example 2.

Example 3

The procedure for preparation of the electrophotographic photoreceptor in Example 1 was repeated except for changing the average thickness of the undercoat layer to 15 μm to prepare an electrophotographic photoreceptor of Example 3.

Example 4

The procedure for preparation of the electrophotographic photoreceptor in Example 1 was repeated except for changing the average thickness of the undercoat layer to 20 μm to prepare an electrophotographic photoreceptor of Example 4.

Example 5

The procedure for preparation of the electrophotographic photoreceptor in Example 1 was repeated except for changing the compound having a thiol group used in the undercoat layer coating liquid to the following compound and the average thickness of the undercoat layer to 25 μm to prepare an electrophotographic photoreceptor of Example 5.

Compound having a thiol group: 1,4-bis(3-mercaptobutyryloxy)butane (Karenz MT™ BD1 from SHOWA DENKO K.K.)

Example 6

The procedure for preparation of the electrophotographic photoreceptor in Example 1 was repeated except for changing the compound having a thiol group used in the undercoat layer coating liquid to the following compound and the average thickness of the undercoat layer to 30 μm to prepare an electrophotographic photoreceptor of Example 6.

Compound having a thiol group: N-dodecylmercaptane (M0814 from Tokyo Chemical Industry Co., Ltd.)

Example 7

The procedure for preparation of the electrophotographic photoreceptor in Example 1 was repeated except for changing the metal oxide particle and the compound having a thiol group used in the undercoat layer coating liquid to the following ones, and the average thickness of the undercoat layer to 3 μm to prepare an electrophotographic photoreceptor of Example 7.

Metal oxide particle: Titanium oxide particle (MT-500B from Tayca Corp.)

Compound having a thiol group: N-dodecylmercaptane (M0814 from Tokyo Chemical Industry Co., Ltd.)

Metal oxide particle: Tin oxide particle (S-1 from Mitsubishi Materials Corp.)

Compound having a thiol group: N-dodecylmercaptane (M0814 from Tokyo Chemical Industry Co., Ltd.)

Comparative Example 1

The procedure for preparation of the electrophotographic photoreceptor in Example 1 was repeated except for changing the compound having a thiol group used in the undercoat layer coating liquid to the following compound having no thiol group to prepare an electrophotographic photoreceptor of Comparative Example 1.

Compound having no thiol group: N-phenyl glycine (P0180 form Tokyo Chemical Industry Co., Ltd.)

Comparative Example 2

The procedure for preparation of the electrophotographic photoreceptor in Comparative Example 1 was repeated except for changing the metal oxide particle used in the undercoat layer coating liquid to a surface-treated zinc oxide particle with the following surface treatment agent having no thiol group to prepare an electrophotographic photoreceptor of Comparative Example 2.

Surface treatment agent: Methyl hydrogen silicone oil (KF-99 from Shin-Etsu Chemical Co., Ltd.)

The specifications of the electrophotographic photoreceptors of Examples 1 to 8 and Comparative Examples 1 to 2 are collectively shown in Table 1.

TABLE 1

| | | Metal Oxide Particle | | |
|---|---|---|---|---|
| | | Material | Surface Treatment | Compound |
| Example | 1 | Zinc oxide particle (MZ-300 from Tayca Corp.) | No | 1,3,5-tris(3-mercaptobutyryloxyethyl)-1,3,5-triazine-2,4,6(1H,3H,5H)-trione (Karenz MT ™ NR1 from SHOWA DENKO K.K.) |
| | 2 | | | |
| | 3 | | | |
| | 4 | | | |
| | 5 | | | 1,4-bis(3-mercaptobutyryloxy) butane (Karenz MT ™ BD1 from SHOWA DENKO K.K.) |
| | 6 | | | N-dodecylmercaptane (M0814 from Tokyo Chemical Industry Co., Ltd.) |
| | 7 | MT-500B from Tayca Corp. | | |
| | 8 | (S-1 from Mitsubishi Materials Corp. | | |
| Comparative Example | 1 | Zinc oxide particle (MZ-300 from Tayca Corp.) | No | N-phenyl glycine (P0180 form Tokyo Chemical Industry Co., Ltd.) |
| | 2 | | Methyl hydrogen silicone oil (KF-99 from Shin-Etsu Chemical Co., Ltd.) | |

Example 8

The procedure for preparation of the electrophotographic photoreceptor in Example 1 was repeated except for changing the metal oxide particle and the compound having a thiol group used in the undercoat layer coating liquid to the following ones, and the average thickness of the undercoat layer to 35 μm to prepare an electrophotographic photoreceptor of Example 8.

<Evaluations of Electrical Properties and Image Quality (Electrophotographic Photoreceptor Properties)>

A modified digital copier (RICOH Pro C900 from Ricoh Co., Ltd.) is used as an evaluation apparatus. The charger employs a scorotron charger (equipped with a discharge wire having a diameter of 50 μm made of gold-plated tungsten-molybdenum alloy). The light source for irradiating light containing image information employs LD light having a wavelength of 780 nm (images are written by polygon mirror and the resolution is 1,200 dpi). The developing device employs a two-component developing method using black toner. The transfer device employs a transfer belt. The neutralizer employs a neutralization lamp.

<<Deterioration Test of Electrophotographic Photoreceptor>>

To cause each electrophotographic photoreceptor to deteriorate, a black single-color test chart (having an image area ratio of 5%) were continuously output on 250,000 sheets under a low-temperature and low-humidity condition of 10° C., 15% RH (LL), a normal-temperature and normal-humidity condition of 23° C., 55% RH (MM) and a high-temperature and high-humidity condition of 27° C., 80% RH (HH).

<<Evaluation of Electrical Properties (Chargeability, Optical Attenuation (Residual Potential), and Short-Term Variation of Optical Attenuation)>>

Each photoreceptor was subjected to a measurement of surface potential before and after the above deterioration procedure. Surface potential was measured with the above digital copier, on which a potential sensor obtained by modifying the developing unit thereof was mounted, in the following manner.

While setting the amount of current applied to the discharge wire to −1,800 μA and the grid voltage to −800 V, a solid image was continuously formed on 100 sheets of A3-size paper in a longitudinal direction. The charged potential (VD) and post-irradiation potential (VL) of the 1st and 100th sheet were measured with a surface potentiometer (Model 344 from Monroe Electronics, Inc.). Surface potential values were recorded by an oscilloscope at 100 signals/sec or more.

[Evaluation Criteria of Chargeability]

Very good: The difference in charged potential (ΔVD) of the 100th sheet before and after the deterioration test of the electrophotographic photoreceptor was less than 10 V.

Good: The difference in charged potential (ΔVD) of the 100th sheet before and after the deterioration test of the electrophotographic photoreceptor was not less than 10 V and less than 20 V.

Poor: The difference in charged potential (ΔVD) of the 100th sheet before and after the deterioration test of the electrophotographic photoreceptor was not less than 20 V.

[Evaluation Criteria of Optical Attenuation (Residual Potential)]

Very good: The difference in residual potential (ΔVL1) of the 100th sheet before and after the deterioration test of photoreceptor was less than 10 V.

Good: The difference in residual potential (ΔVL1) of the 100th sheet before and after the deterioration test of photoreceptor was not less than 10 V and less than 30 V.

Poor: The difference in residual potential (ΔVL1) of the 100th sheet before and after the deterioration test of photoreceptor was not less than 30 V.

[Evaluation Criteria of Short-Term Variation of Optical Attenuation]

Very good: The difference in residual potential (ΔVL2) of the 1st sheet and the 100th sheet before and after the deterioration test of photoreceptor was less than 10 V.

Good: The difference in residual potential (ΔVL2) of the 1st sheet and the 100th sheet before and after the deterioration test of photoreceptor was not less than 10 V and less than 30 V.

Poor: The difference in residual potential (ΔVL2) of the 1st sheet and the 100th sheet before and after the deterioration test of photoreceptor was not less than 30 V.

<Image Quality Evaluation>

Images were produced before and after the deterioration test of the electrophotographic photoreceptor and subjected to evaluations in terms of residual image and background fouling.

Whether residual image was generated or not was determined by continuously producing an x-shaped pattern with a size of 3 cm×3 cm on 3 sheets, then continuously producing a halftone image on 3 sheets, and visually observing the images.

Whether background fouling was generated or not was determined by continuously producing white solid image on 5 sheets or gloss-coated paper, and visually observing the images.

The evaluation results of the electrical properties and image quality (properties of the electrophotographic photoreceptor) of Examples 1 to 8 and Comparative Examples 1 to 2 are shown in Table 2.

TABLE 2

(1)

| | | ΔVD | | | ΔVL1 | | |
|---|---|---|---|---|---|---|---|
| | | LL | MM | HH | LL | MM | HH |
| Example | 1 | Good | Very good | Very good | Very good | Very good | Good |
| | 2 | Good | Very good | Very good | Very good | Very good | Good |
| | 3 | Very good | Very good | Very good | Very good | Very good | Good |
| | 4 | Very good | Very good | Very good | Very good | Very good | Very good |
| | 5 | Very good | Very good | Good | Good | Very good | Very good |
| | 6 | Very good | Very good | Good | Good | Good | Very good |
| | 7 | Good | Very good | Very good | Very good | Good | Good |
| | 8 | Very good | Very good | Good | Good | Good | Very good |
| Comparative | 1 | Very good | Very good | Very good | Poor | Good | Good |
| Example | 2 | Good | Very good | Very good | Poor | Good | Good |

(2)

| | | ΔVL2 before Test | | | ΔVL2 after Test | | |
|---|---|---|---|---|---|---|---|
| | | LL | MM | HH | LL | MM | HH |
| Example | 1 | Very good | Very good | Good | Very good | Good | Good |
| | 2 | Very good | Very good | Good | Very good | Good | Good |
| | 3 | Very good | Very good | Very good | Very good | Very good | Good |
| | 4 | Good | Very good | Very good | Good | Very good | Very good |

TABLE 2-continued

| | | | | | | | |
|---|---|---|---|---|---|---|---|
| | 5 | Good | Very good | Very good | Good | Good | Very good |
| | 6 | Good | Very good | Very good | Good | Good | Very good |
| | 7 | Very good | Good | Good | Very good | Good | Good |
| | 8 | Good | Very good | Very good | Good | Good | Very good |
| Comparative Example | 1 | Poor | Very good | Very good | Poor | Good | Very good |
| | 2 | Poor | Poor | Good | Poor | Poor | Good |

(3)

| | | Image Quality | | |
|---|---|---|---|---|
| | | LL | MM | HH |
| Example | 1 | Very good | Very good | Good |
| | 2 | Very good | Very good | Good |
| | 3 | Very good | Very good | Very good |
| | 4 | Very good | Very good | Very good |
| | 5 | Good | Very good | Very good |
| | 6 | Good | Good | Good |
| | 7 | Good | Good | Good |
| | 8 | Good | Good | Good |
| Comparative Example | 1 | Residual Image and Background Fouling after Deterioration | Background Fouling after Deterioration | Background Fouling after Deterioration |
| | 2 | Residual Image after Deterioration | Residual Image after Deterioration | Good |

Table 2 shows each of the electrophotographic photoreceptors of Examples 1 to 8 having an undercoat layer including a binder resin, a metal oxide particle and a compound having a thiol group can have stable electrical properties and image quality for long periods even under an environment of high temperature and high humidity or low temperature and low humidity.

Particularly, each of the electrophotographic photoreceptors of Examples 1 to 6 having an undercoat layer including a zinc oxide particle as a metal oxide particle can have sufficiently stable electrical properties and image quality for long periods even under an environment of high temperature and high humidity or low temperature and low humidity.

When each the electrophotographic photoreceptors of Comparative Examples 1 and 2 was used for long periods, the difference of the residual potential thereof particularly under low temperature and low humidity before and after the deterioration test became larger. Further, image quality was not stabilized, such as background fouling and residual image after the deterioration test.

Having now fully described the invention, it will be apparent to one of ordinary skill in the art that many changes and modifications can be made thereto without departing from the spirit and scope of the invention as set forth therein.

What is claimed is:

1. An electrophotographic photoreceptor, comprising:

a substrate;

an undercoat layer overlying the substrate; and a charge generation layer and a charge transport layer overlying the undercoat layer, wherein the undercoat layer comprises a binder resin, a metal oxide particle and a compound having a thiol group selected from the group consisting of 1,3,5-tris(3-mercaptobutyryloxyethyl)-1,3,5-triazine-2,4,6(1H,3H,5H)-trione, 1,4-bis(3-mercaptobutyryloxy) butane, and N-dodecylmercaptane.

2. The electrophotographic photoreceptor of claim 1, wherein the compound having a thiol group is a chain-transfer agent having a thiol group.

3. The electrophotographic photoreceptor of claim 1, wherein the metal oxide particle is a zinc oxide particle.

4. The electrophotographic photoreceptor of claim 1, wherein the compound having thiol group has at least two thiol groups.

5. The electrophotographic photoreceptor of claim 1, wherein the undercoat layer has an average thickness of from 5 μm to 30 μm.

6. An image forming apparatus, comprising:

the electrophotographic photoreceptor according to claim 1;

a charger to charge the surface of the electrophotographic photoreceptor;

an irradiator to irradiate the surface of the electrophotographic photoreceptor to form an electrostatic latent image thereon;

an image developer to develop the electrostatic latent image with a toner to form a visible image on the electrophotographic photoreceptor; and a transferer to transfer the visible image onto a recording medium.

7. A process cartridge, comprising:

the electrophotographic photoreceptor according to claim 1; and at least one of a charger to charge the surface of the electrophotographic photoreceptor, an irradiator to irradiate the charged surface of the electrophotographic photoreceptor to form an electrostatic latent image thereon, an image developer to develop the electrostatic latent image with a toner to form a visible image on the electrophotographic photoreceptor, and a transferer to transfer the visible image onto a recording medium.

* * * * *